US007343680B2

(12) United States Patent
Yoon et al.

(10) Patent No.: US 7,343,680 B2
(45) Date of Patent: Mar. 18, 2008

(54) METHOD FOR MANUFACTURING DIAL KNOB OF WASHING MACHINE

(75) Inventors: Seong No Yoon, Changwon-si (KR); Bong Sang Lee, Changwon-si (KR); Sung Rak Gong, Busan (KR); Bo Yeon Kim, Changwon-si (KR); Seong Yeol Lee, Daegu (KR); Dae Hee Kwon, Busan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/401,965

(22) Filed: Apr. 12, 2006

(65) Prior Publication Data

US 2006/0180452 A1 Aug. 17, 2006

Related U.S. Application Data

(62) Division of application No. 11/048,742, filed on Feb. 3, 2005.

(30) Foreign Application Priority Data

Jun. 30, 2004 (KR) ..... 10-2004-0050197

(51) Int. Cl.
*B21D 53/00* (2006.01)

(52) U.S. Cl. ..... 29/896.5; 29/428; 29/458; 29/557; 200/564; 200/296

(58) Field of Classification Search ..... 29/896.5, 29/428, 458, 527.2, 557, 558; 200/564, 296, 200/310, 313, 316, 336, 308, 309, 317
See application file for complete search history.

(56) References Cited

U.S. PATENT DOCUMENTS

| | | | | |
|---|---|---|---|---|
| 5,359,165 | A * | 10/1994 | Leveque et al. | 200/317 |
| 5,391,848 | A * | 2/1995 | Murphy | 200/314 |
| 5,641,952 | A | 6/1997 | Collings et al. | |
| 6,032,609 | A | 3/2000 | Luoma | |
| 6,155,691 | A * | 12/2000 | Miyasaka | 362/30 |
| 6,228,351 | B1 | 5/2001 | Viders | |
| 6,768,075 | B2 | 7/2004 | Kikuchi et al. | |
| 6,894,242 | B2 | 5/2005 | Muller et al. | |
| 7,059,735 | B2 * | 6/2006 | Orikasa | 362/23 |

* cited by examiner

*Primary Examiner*—Jermie E. Cozart
(74) *Attorney, Agent, or Firm*—Birch, Stewart, Kolasch & Birch, LLP

(57) ABSTRACT

A dial knob of a washing machine is provided. In the dial knob, a dial is inserted into a center part of a knob guard, and a periphery edge of the knob is formed to be lustrous. A lamp window body is securely attached on a rear surface of the knob guard. The knob guard is formed of an aluminum material. Thereafter, a front surface of the knob guard is formed to be lusterless and an edge of the front surface is formed to be lustrous. Finally, the dial is connected to the lamp window body.

24 Claims, 7 Drawing Sheets

METHOD FOR MANUFACTURING DIAL KNOB OF WASHING MACHINE

This application is a Divisional of co-pending application Ser. No. 11/048,742 filed on Feb. 3, 2005 for which priority is claimed under 35 U.S.C. § 120. Application Ser. No. 11/048,742 which is still pending and claims the benefit of the Korean Application No. P2004-50197 filed on Jun. 30, 2004 which is hereby incorporated by reference.

BACKGROUND OF THE INVENTION

1. Field of the Invention

The present invention relates to a washing machine, and more particularly, to a dial knob installed at a control panel assembly of a washing machine so as to set a washing condition, and a manufacturing method thereof.

2. Discussion of the Related Art

In general, a washing machine is broadly classified into a pulsator-type washing machine with a vertically-installed drum, and a drum-type washing machine with a horizontally-installed drum.

In the drum-type washing machine, the laundry loaded into the drum is dropped and washed by the rotation of the drum.

Particularly, the drum-type washing machine has a control panel assembly installed at a front upper part thereof, for setting a washing condition and for displaying a washing state.

FIG. 1 illustrates a structure in which a dial knob is installed at the control panel assembly of the drum-type washing machine.

Referring to FIG. 1, a dial knob 10 is rotatably connected to a control panel assembly 15, and is used for inputting or selecting various washing conditions.

The dial knob 10 is attached on a center part or a side edge part of the control panel assembly 15.

The dial knob 10 includes a dial 11, a knob guard 12 and a plurality of lamp windows 13.

The dial 11 is rotated by a user, and is formed to have an about-cylindrical shape whose frond side is closed.

The knob guard 12 is ring-shaped and connected to the control panel assembly 15, and has a central opening through which the dial 11 is penetrated.

A plurality of window insertion holes 14 are formed on the knob guard 12.

A plurality of washing condition marks are printed on a surface of the control panel assembly 15 around a periphery of the knob guard 12.

The lamp windows 13 are respectively inserted into the window insertion holes 14.

A plurality of lamps (not shown) are respectively attached on rear surfaces of the lamp windows 13, whereby light rays of the lamps are respectively emitted through the lamp windows 13.

In the meantime, the knob guard 12 is manufactured by injection molding with an electroformed mold. A surface of the knob guard 12 is plated with metallic material. Here, the electroformed mold is a kind of a mold manufactured by electrolytically plating a pattern with nickel, copper, or the like, the pattern being made of glass, plastics, metal gypsum, wax, or the like so as to have the same shape as a molded article.

However, although it is possible for the knob guard 12 to be designed to have a simple metallic surface, it is difficult for the knob guard 12 to be designed to have a both lustrous and lusterless surface.

SUMMARY OF THE INVENTION

Accordingly, the present invention is directed to a dial knob of a washing machine and a manufacturing method thereof that substantially obviates one or more problems due to limitations and disadvantages of the related art.

An object of the present invention is to provide a dial knob attached on a front side of a washing machine and a manufacturing method thereof, the dial knob having a knob guard, the knob guard being designed to have a both lustrous and lusterless surface.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dial knob of a washing machine includes: a rotatable dial; a knob guard including a central opening through which the rotatable dial is penetrated, a plurality of window insertion holes formed to be penetrated therethrough, and a lustrous part formed at an front outer edge thereof; and a window body installed at a rear surface of the knob guard and having lamp windows protruded from a front surface thereof to then be penetrated through the knob guard and be exposed outside.

A lusterless part may be formed on a front surface of the knob guard.

The front outer edge may be chamfered to have a chamfer and the lustrous part may be formed on the chamfer.

An outwardly-bending end may be formed on a rear periphery surface of the dial so as to prevent the dial being stripped toward a penetration direction when the dial is penetrated through the center part of the knob guard.

The dial and/or the knob guard may be formed of an aluminum material.

An insertion groove of a given depth may be formed in a rear surface of the knob guard and the window body may be inserted and connected into the insertion groove.

In another aspect of the present invention, a method for manufacturing a dial know of a washing machine includes the steps of: (a) forming an outer shape of a knob guard; (b) processing a front surface of the knob guard so that the front surface becomes lusterless; (c) penetrating a dial through a center part of the knob guard and connecting the dial with the center part; and (d) connecting a window body to a rear surface of the knob guard.

The step (a) may be performed by an MCT system and/or by an aluminum whole process through a CNC.

The step (b) may be performed through a surfacing process of forming a plurality of fine grooves on the front surface of the knob guard.

The method may further include the step of forming a chamfer at a periphery edge of the knob guard prior to the step (c), and the chamfer may be processed to be lustrous through a mirror coating process.

According to the above construction of the present invention, a dial knob attached on a front side of a washing machine can be designed to have a both lustrous and lusterless surface.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A dial knob of a washing machine according to an embodiment of the present invention will now be described with reference FIGS. 2 through 4.

Figure 1:
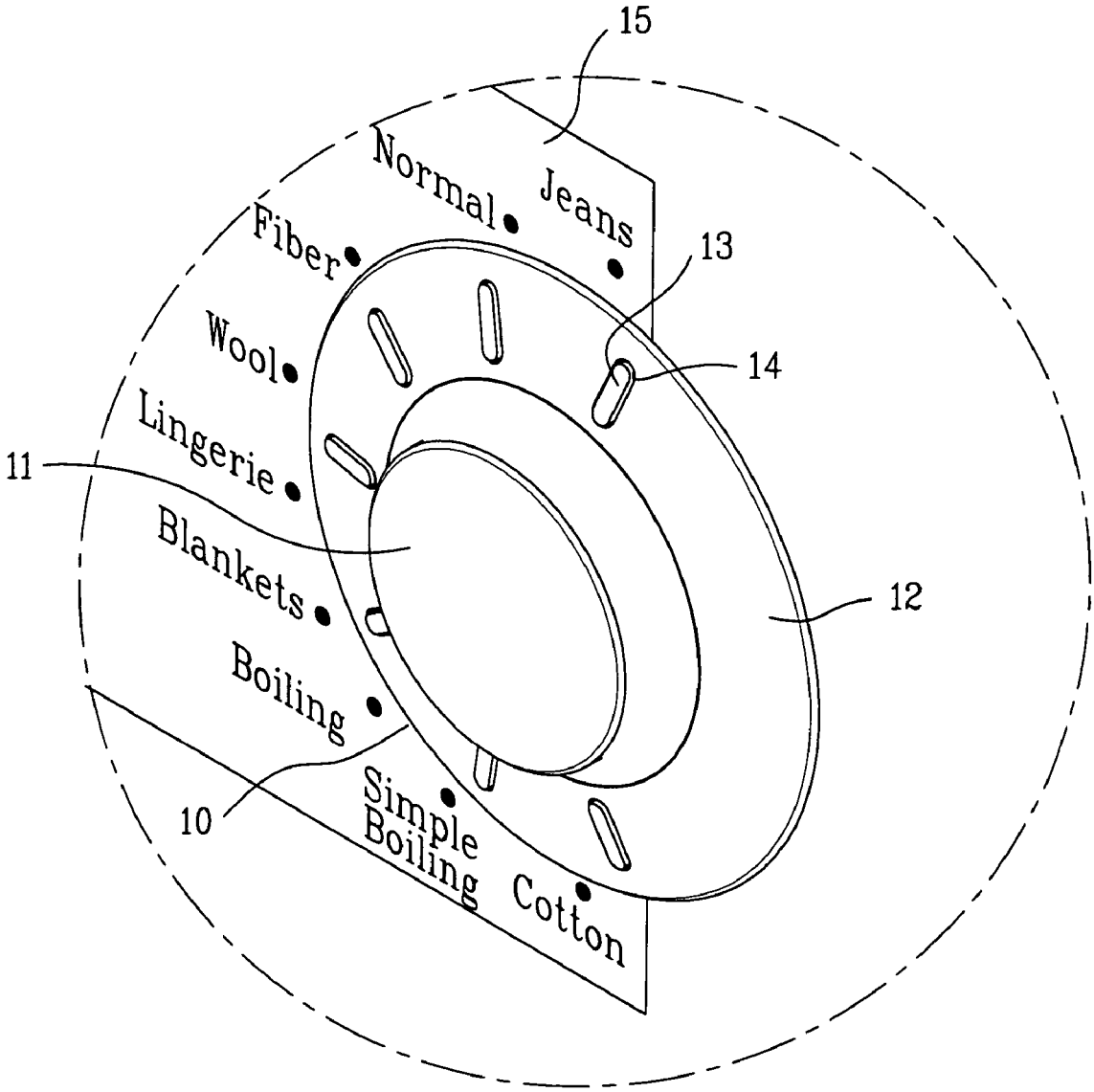
FIG. 1 Related Art
FIG. 1 is an enlarged perspective view illustrating a dial knob structure of a conventional washing machine.
Figure 2:
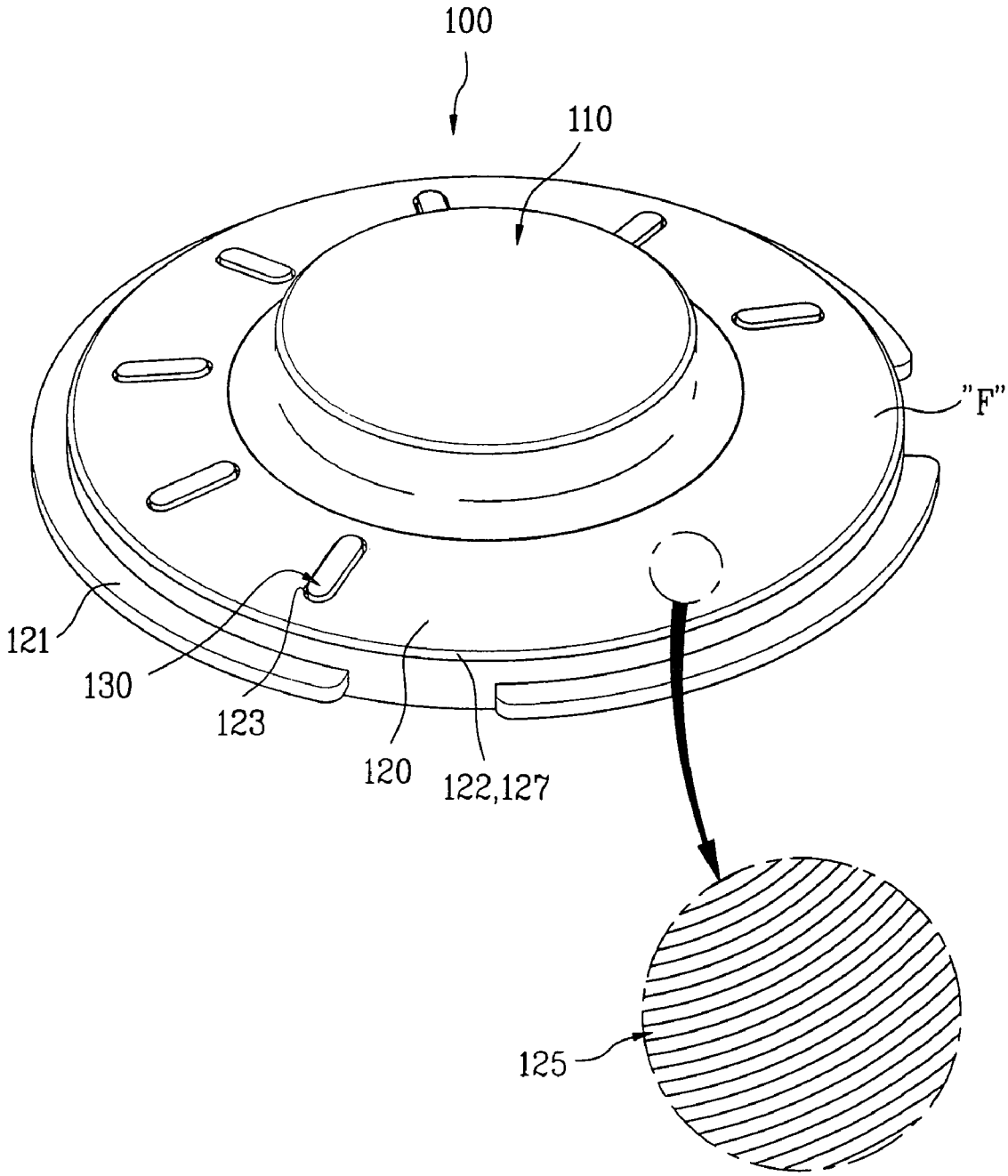
FIG. 2 is a front perspective view of a dial knob according to an embodiment of the present invention.
Figure 3:
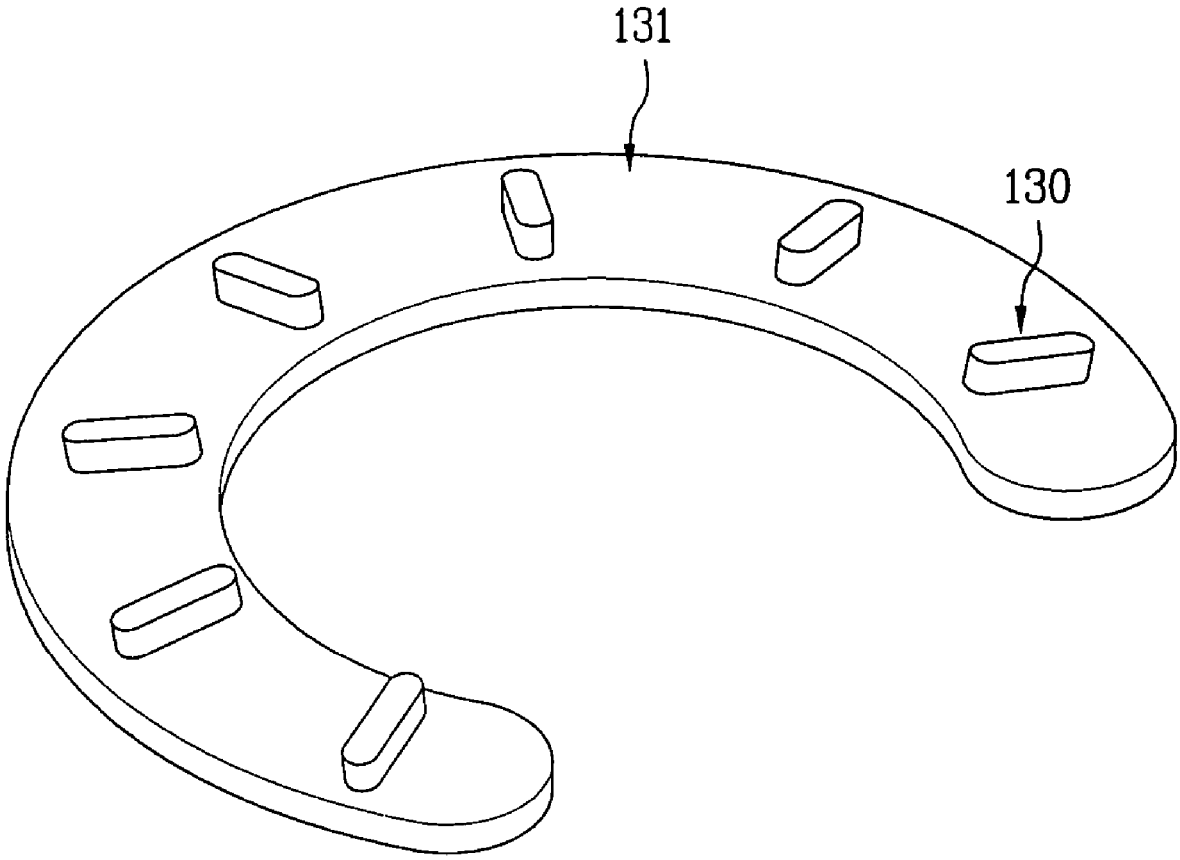
FIG. 3 is a perspective view illustrating a lamp window body of the dial knob shown in FIG. 2.
Figure 4:
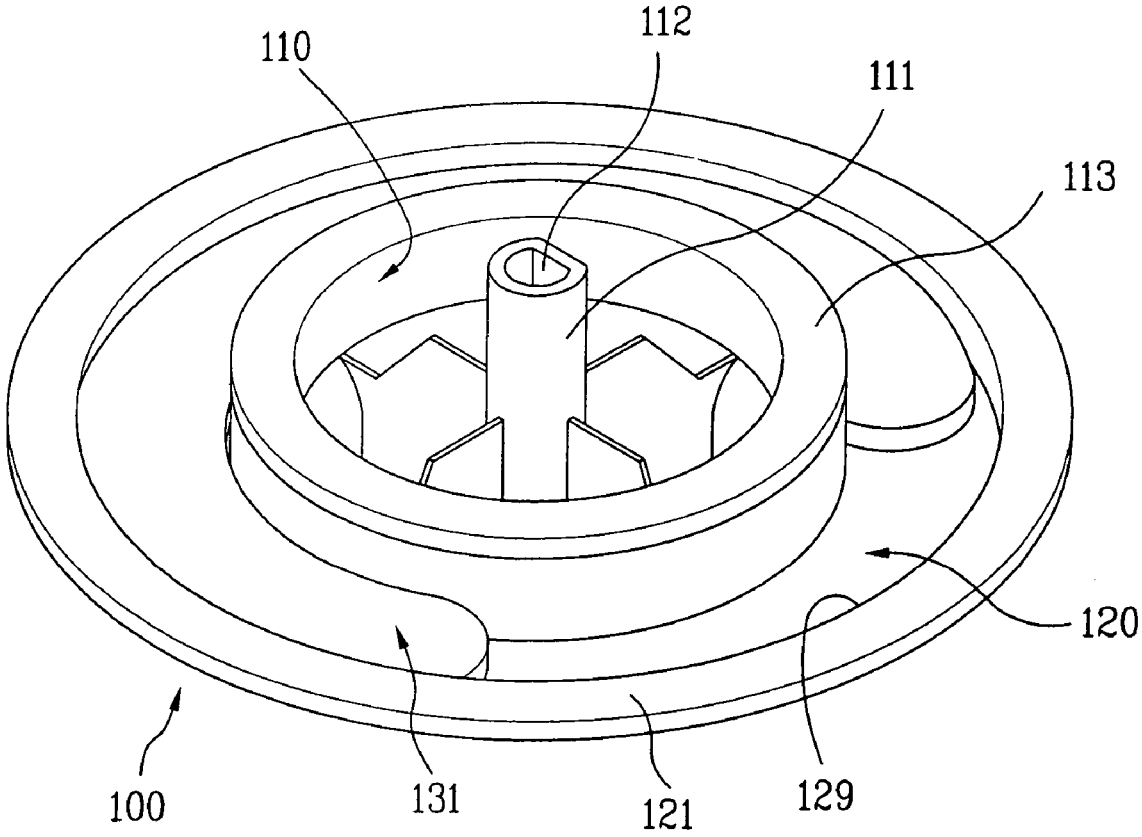
FIG. 4 is a rear perspective view of the dial knob shown in FIG. 2.

Here, FIG. 2 is a front perspective view of a dial knob according to an embodiment of the present invention, FIG. 3 is a perspective view of a lamp window body attached on a rear side of the dial knob, and FIG. 4 is a rear perspective view of the dial knob.

Referring to FIGS. 2 through 4, a dial knob 100 is attached to protrude from a front surface of a control panel assembly (not shown), and includes a dial 110, a knob guard 120 and a window body 131.

The knob guard 120 is ring-shaped and has a central through opening.

The dial 110 is installed into the central through opening.

A front surface "F" of the knob guard 120, which is exposed outside, may be formed aligned with the front surface of the control panel assembly, or is preferably formed in such a way that it gradually ascends from its outer periphery to its inner periphery.

The knob guard 120 is preferably formed of aluminum so as to have a metallic luster while being lightweight, or may be formed various materials other than aluminum.

A plurality of window insertion holes 123, into which a plurality of lamp windows 130 are respectively inserted, are formed on the knob guard 120 to be spaced apart from one another by a given distance.

Particularly, a lusterless part 125 is formed on the front surface "F" of the knob guard 20.

The lusterless part 125 is formed by forming a plurality of circular hairlines on the knob guard 120, and the circular striations are formed through a hairline process.

The hairline process is a kind of a surfacing process forming a plurality of fine circular scratches on a surface of a processing object by bringing a surfacing material (such as sandpaper) into contact with the surface of the processing object while rotating the processing object fixed to a jig.

Here, the fine circular scratch is called a hairline, and the hairline's surface does not reflect light to thereby become lusterless.

The lusterless part 125 may be formed on the whole front surface of the knob guard 120, or may be formed on only a portion of the front surface of the knob guard 120.

At this time, the other portions of the front surface, on which the opaque part 125 is not formed, is preferably formed to have luster.

Also, a lustrous part 127 is formed on an outer edge of the front surface of the knob guard 120.

At this time, it is preferable that a chamfer 122 is formed on the outer edge of the knob guard 120 and the lustrous part 127 is then formed on the chamfer 122.

The lustrous part 127 is formed through a mirror coating process. The mirror coating process is a kind of a process for coating a surface of an object with gold, silver, mercury, ink, or the like.

In the meantime, at least one or more detachment prevention ribs 121 of given width and length are formed on a periphery surface of the knob guard 120. The detachment prevention ribs 121 prevent the knob guard 120 being stripped from the control panel assembly when the knob guard 120 is penetrated from a rear surface of the control panel assembly to a front surface of the control panel assembly to thereby be connected.

The dial 110 is rotated by a user, and is formed to have an about-cylindrical shape whose front side is closed. At this time, the dial 110 is preferably formed to have a diameter and a height allowing a user to smoothly hold the dial 110.

Also, an outwardly-bending end 113 is formed on a rear periphery surface of the dial 110. At this time, the bending end 113 prevents the dial 110 being stripped toward a penetration direction when the dial 110 is penetrated through a center part of the knob guard 120.

A rotation axis 111 of a given diameter and length is included in a rear surface of the dial 110. At this time, a boss insertion hole 112 is formed at a center part of the rotation axis 111, and a boss (not shown) protruded from the control panel assembly is inserted into the boss insertion hole 112. The boss is rotated according to the rotation of the dial 110, whereby washing conditions are set.

The boss insertion hole 112 is preferably formed to have a key shape, that is, a partially-flattened circle, so that the boss should not be vainly rotated.

The dial 110 may be formed of a plastic material, or an aluminum material. Of course, the dial 110 may be formed to have a lusterless surface through the formation of the hairlines, or to have a lustrous surface through the mirror coating process.

The window body 131 is installed on a rear surface of the knob guard 120, and the lamp windows 130 are protruded from a front surface of the window body 131 and penetrated through the window insertion holes 123.

At this time, it is preferable that an insertion groove 129 of a given depth is formed in a rear surface of the knob guard 120 and the window body 131 is inserted and connected into the insertion groove 129. Here, it is preferable that the insertion groove 129's depth is equal to or larger than the window body 131's thickness.

Referring to FIG. 3, the plurality of the lamp windows 130 are formed to be protruded from a front surface of the window body 131, and are arranged along a circumferential direction of the window body 131 to be spaced apart from one another by a given distance.

Preferably, the lamp windows 130 are formed of a light-transmissible material so that light rays emitted from lamps (not shown) installed in the control panel assembly can be respectively penetrated through the lamps windows 130. That is, the lamp window is preferably formed of a transparent plastic.

Also, the lamp windows 130 may be formed of other materials that are lightweight, highly-transparent and low-cost.

A manufacturing process of the dial knob 100 will now be described with reference FIGS. 5A through 5D and 6.

Figure 5A:
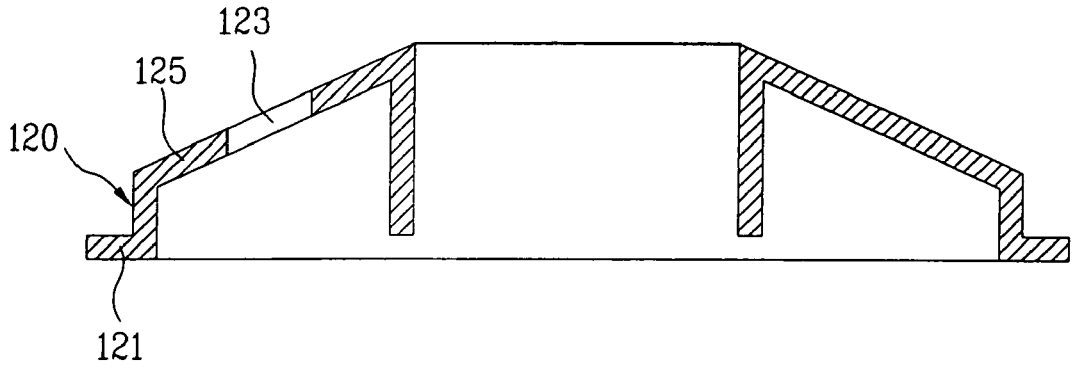
FIGS. 5A through 5D are views illustrating a manufacturing process of the dial knob shown in FIG. 2.
Figure 5B:
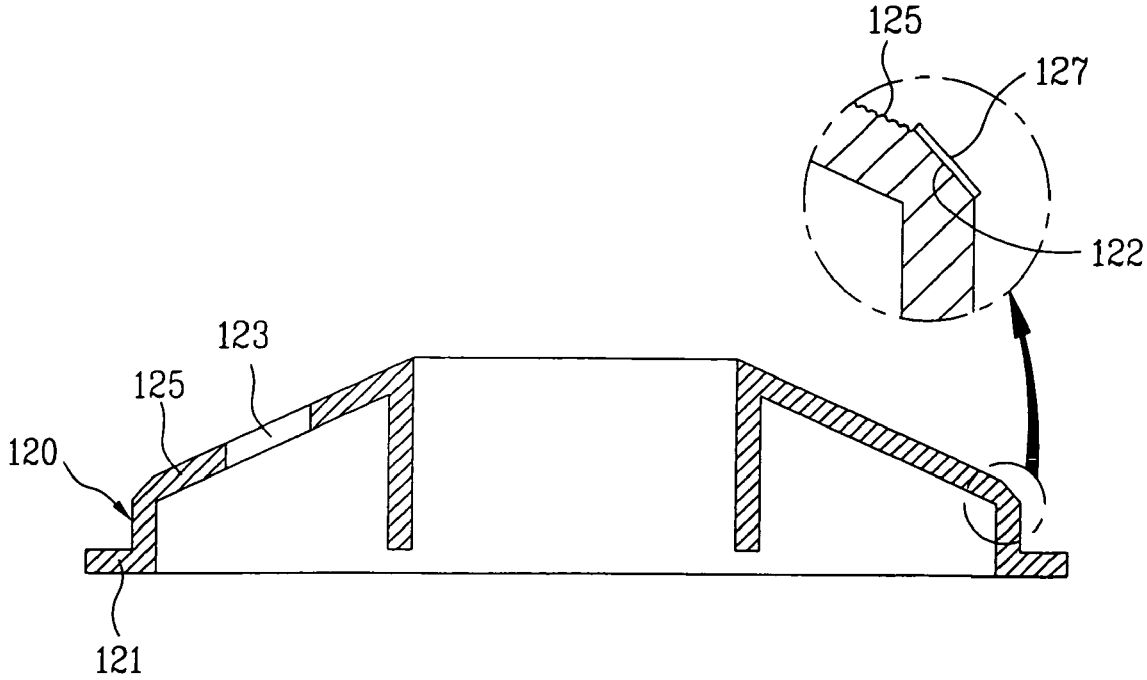
Figure 5C:
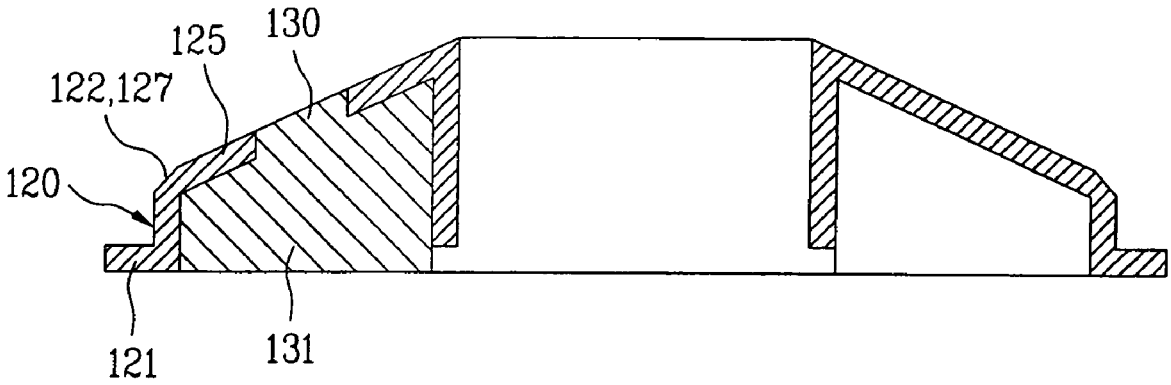
Figure 5D:
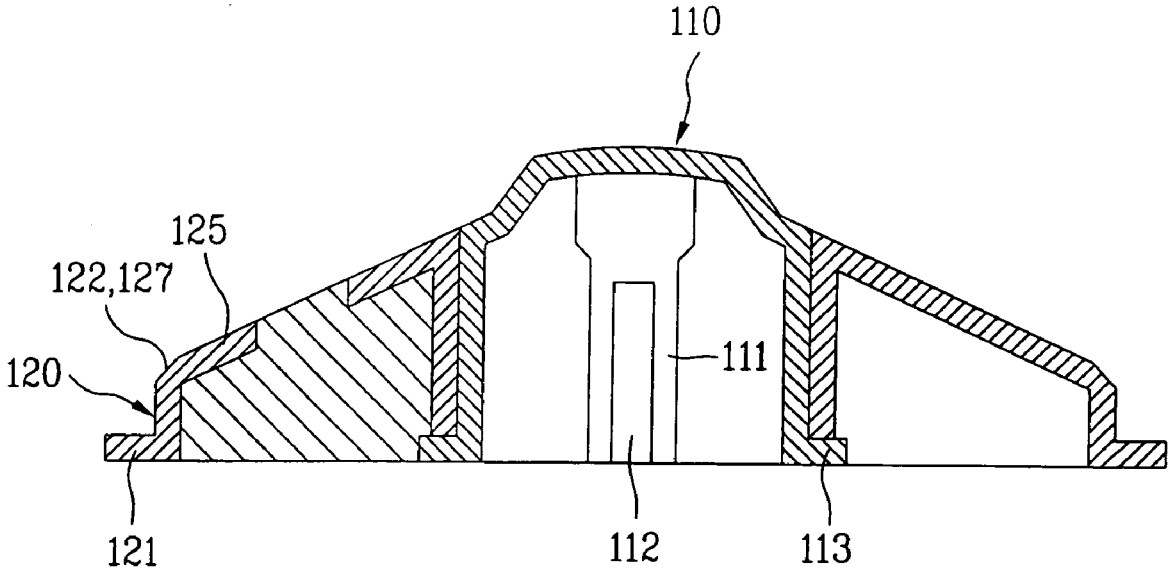
Figure 6:
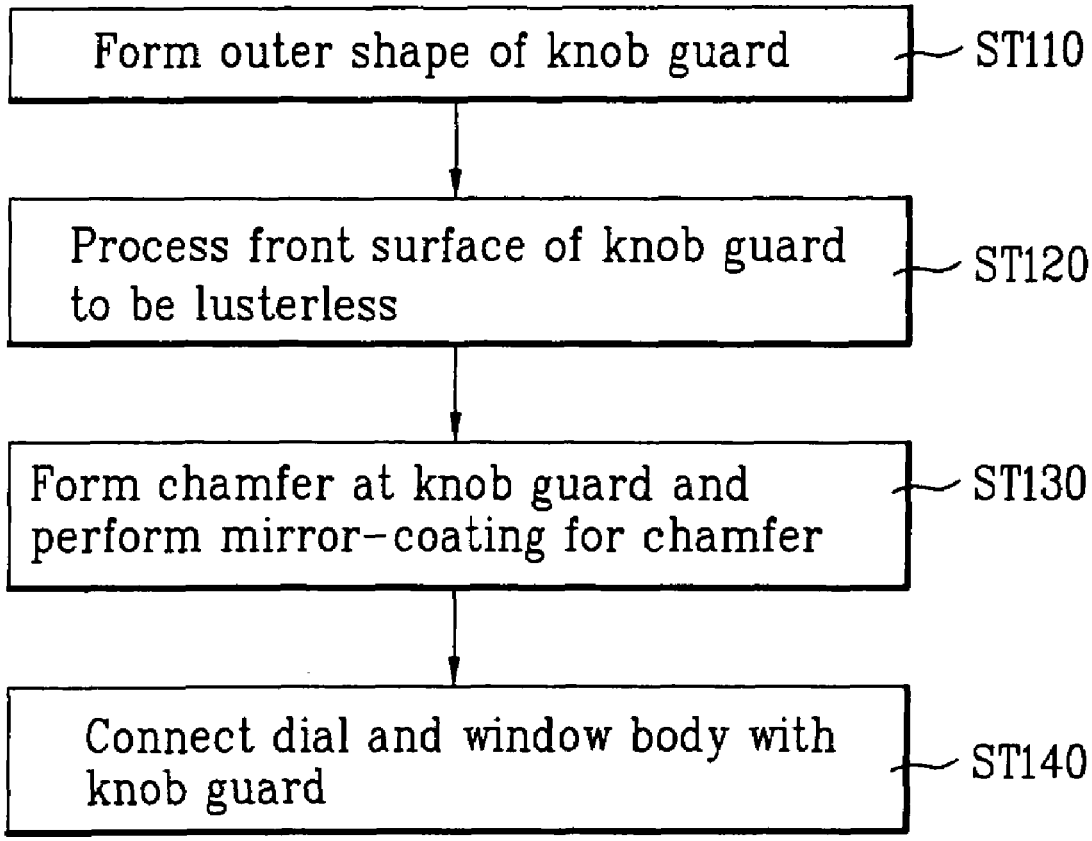
FIG. 6 is a flow diagram illustrating the manufacturing process of the dial knob shown in FIG. 2.

FIGS. 5A through 5D are diagrams illustrating a manufacturing process of the dial knob, and FIG. 6 is a flow diagram illustrating the manufacturing process of the dial knob.

As shown in FIG. 5A, an outer shape of the knob guard 120 is firstly formed by a machining center tooling (MCT) system and/or by an aluminum whole process through the computer numerical control (CNC) (ST110).

The knob guard 120 may also be formed by injection molding with an electroformed mold.

The lusterless part 125 is formed at a front surface of the formed knob guard 120 (ST1200. In detail, the lusterless part 125 is formed by performing a surfacing process of forming a plurality of fine grooves on the front surface of the knob guard 120. That is, the front surface of the knob guard 120 is hairline-processed.

As shown in FIG. 5B, the chamfer 122 is formed at a periphery edge of the knob guard 120. That is, the periphery edge is chamfered to form an inclined surface of a given width.

Thereafter, the lustrous part 127 is formed through the mirror-coating of the chamfer 122 (ST130), whereby the chamfer becomes lustrous.

After the completion of the formation of the knob guard 120, the window body 131 is installed into the insertion groove formed in a rear surface of the knob guard 120, as shown in FIG. 5C. At this time, the lamp windows 130 of the window body 131 are respectively installed into the window insertion holes 123 of the knob guard 120.

As shown in FIG. 5D, the dial 110 is penetrated through and connected with a center part of the knob guard 120, whereby the dial knob 100 is completed manufactured. Of course, the attachment of the window body 131 to the knob guard 120 may be performed after the attachment of the dial 1 10 to the knob guard 120.

As described previously, the present invention has the following effects.

First, the knob guard is formed through an aluminum whole process, whereby the knob guard can have a surface with a source material feeling.

Secondly, the chamfer of the knob guard is lustrous but the front side of the knob guard is lusterless, whereby the knob guard can have a both lustrous and lusterless surface.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for manufacturing a dial knob of a washing machine, the method comprising the steps of:

(a) forming an outer shape of a knob guard;

(b) processing a front surface of the knob guard so that the front surface becomes lusterless;

(c) penetrating a dial through a center part of the knob guard and connecting the dial with the center part; and (d) connecting a window body to a rear surface of the knob guard.

2. The method of claim 1, wherein the step (a) is performed by an MCT (machining center tooling) system and/or by an aluminum whole process through a CNC (computer numerical control).

3. The method of claim 1, wherein the step (b) is performed through a surfacing process of forming a plurality of fine grooves on the front surface of the knob guard.

4. The method of claim 3, wherein the surfacing process is a hairline process.

5. The method of claim 1, wherein further comprising the step of forming a lustrous portion on the knob guard prior to the step (c).

6. The method of claim 5, wherein the forming step includes providing a mirror coating on a chamfer formed at a periphery edge of the knob guard.

7. The method of claim 6, wherein the mirror coating comprises a material selected from one of gold, silver, mercury, and ink.

8. The method of claim 1, wherein the step (d) is performed prior to the step (c).

9. The method of claim 1, wherein the processing step includes processing the front surface of the knob guard such that at least a partial portion of the front surface of the knob guard is lusterless, and wherein the forming step includes forming the knob guard being a same material from the lusterless partial portion of the front surface of the knob guard to the rear surface of the knob guard.

10. The method of claim 9, wherein the same material is a metal.

11. The method of claim 9, wherein the processing step includes removing the same material from the front surface of the knob guard, thereby forming the lusterless partial portion of the front surface.

12. The method of claim 11, wherein the lusterless partial portion of the front surface is a metal surface.

13. The method of claim 9, further comprising forming a lustrous part at a front outer edge of the knob guard.

14. The method of claim 1, wherein the forming step includes forming the knob guard being a same material from the lusterless front surface of the knob guard to a rear surface of the knob guard.

15. The method of claim 14, wherein the same material is a metal.

16. The method of claim 14, wherein the processing step includes removing the same material from the front surface of the knob guard, thereby forming the lusterless front surface.

17. The method of claim 16, wherein the lusterless front surface is a metal surface.

18. The method of claim 1, wherein the processing step includes removing a material from the front surface of the knob guard, thereby forming the lusterless front surface.

19. The method of claim 18, wherein the material is a metal.

20. The method of claim 18, wherein the lusterless front surface is a metal surface.

21. The method of claim 1, wherein the penetrating and connecting step includes engaging an outwardly-bending end formed on a rear periphery of the dial with the center part of the knob guard.

22. The method of claim 1, wherein the connecting step includes inserting the window body into an insertion recess formed at a rear surface of the knob guard.

23. The method of claim 1, wherein the connecting step includes inserting lamp windows protruding from the window body into insertion holes formed at the knob guard.

24. The method of claim 1, wherein the forming step includes forming at least one detachment prevention rib on the knob guard.

* * * * *